US005799522A

United States Patent [19]

Ohta

[11] Patent Number: 5,799,522

[45] Date of Patent: Sep. 1, 1998

[54] KEY HOLDER

[75] Inventor: Seiya Ohta, Eybens, France

[73] Assignee: Hewlett-Packard Company, Palo Alto, Calif.

[21] Appl. No.: 674,053

[22] Filed: Jul. 1, 1996

[30] Foreign Application Priority Data

Jul. 31, 1995 [EP] European Pat. Off. ..... 95410078

[51] Int. Cl.[6] ..... A44B 15/00

[52] U.S. Cl. ..... 70/456 R; 70/408

[58] Field of Search ..... 70/456 R–459, 70/408

[56] References Cited

U.S. PATENT DOCUMENTS

| | | | |
|---|---|---|---|
| 1,561,262 | 11/1925 | Martin | 70/456 R X |
| 1,974,558 | 9/1934 | Andis | 70/456 R |
| 2,025,960 | 12/1935 | Sindler . | |
| 2,069,317 | 2/1937 | Lipic, Jr. | 70/456 R |
| 2,078,293 | 4/1937 | Smith, Jr. | 70/456 R |
| 2,226,969 | 12/1940 | D'Onofrio | 70/456 R |
| 2,371,308 | 3/1945 | Mosch | 70/456 R |
| 2,706,902 | 4/1955 | Nichols | 70/456 R |
| 2,908,156 | 10/1959 | Preston | 70/456 R |
| 4,160,369 | 7/1979 | Pearson | 70/456 R |
| 4,297,864 | 11/1981 | Beier | 70/456 B |
| 4,475,367 | 10/1984 | Raitto | 70/456 R |
| 4,571,967 | 2/1986 | Jacobsen | 70/456 R |
| 4,628,717 | 12/1986 | Blum | 70/456 R |
| 4,631,770 | 12/1986 | Goldberg | 70/456 R X |
| 4,870,844 | 10/1989 | Sandrini | 70/456 R |
| 4,901,549 | 2/1990 | Dengel | 70/456 R |
| 4,910,983 | 3/1990 | Taylor | 70/456 R |
| 4,939,917 | 7/1990 | Cartwright | 70/456 R |
| 4,951,488 | 8/1990 | Hogan | 70/456 R |
| 5,179,748 | 1/1993 | Lipic | 70/456 R X |
| 5,440,910 | 8/1995 | Florian | 70/456 R |
| 5,460,022 | 10/1995 | Parsons | 70/456 R |
| 5,487,291 | 1/1996 | Voigt | 70/456 R |

FOREIGN PATENT DOCUMENTS

| | | |
|---|---|---|
| A2129220 | 3/1971 | France . |
| C880 919 | 7/1949 | Germany . |
| U8530112 | 10/1985 | Germany . |
| 7018928 | 2/1995 | Japan . |

*Primary Examiner*—Suzanne Dino Barrett

[57] ABSTRACT

A key holder is provided for holding, for example, a pair of keys and associating them with the corresponding lock during transport of an article incorporating the lock. The key holder comprises a shank portion insertable into the lock, and a key-carrier portion connected to one end of the shank portion and preferably adapted to hold the pair of keys in a plane substantially perpendicular to the direction of extent of the shank portion. The key holder is, for example, of one-piece construction and made of a resilient plastics material.

8 Claims, 3 Drawing Sheets

KEY HOLDER

FIELD OF THE INVENTION

The present invention relates to a key holder for holding one or more keys particularly, though not exclusively, during transport of an article provided with an externally-operated lock.

BACKGROUND OF THE INVENTION

Articles such as filing cabinets or computer processor boxes are often provided with externally-operable physical locks. When such an article is shipped from a factory, the key (or generally a pair of keys) for operating the lock will normally be shipped jointly with the article. Where the article can be shipped in an unlocked condition, the key or keys can be placed inside the article; however, it is often desired to ship the article in a locked condition and in such cases at least one of the keys must be attached to the outside of the article. One way of doing this that is frequently used is to tape the key to the outside of the article with adhesive tape; however, this is not a reliable solution and is inconvenient to implement. Other fixing methods such as using plastic straps, whilst being more reliable, also suffer from inconvenience in application.

Another approach is simply to leave the key in the lock. However, since the key head will then protude from the article, this approach can result in the key head being snapped off or damaged during transport and handling. This drawback may be minimised by the use of the known form of key 10 illustrated in FIGS. 1 and 2. This key has its key head (the part of the key that enables a user to turn the key 10) formed by a base part 12 rigid with one end of the key shank 13, and a main part 14 pivotal on the base part 12 about axis I—I between an operative position in which it provides an extension to the key shank as normal, and a folded down position in which it extends in a plane normal to the key shank. In its folded-down position, the main part 14 of the key head will lie flat juxtaposed a wall member 15 in which the lock 16 receiving the key 10 is mounted (see dotted outline position of part 14 in FIG. 2). The risk of the key head getting damaged (or, indeed, of causing damage) when folded down in this position is small.

The form of key shown in FIGS. 1 and 2 is useful not only during transport of an article but in day-to-day use where the key may be left in a lock. However, the provision of a two-part key head with a pivoted inter-connection of the parts adds expense that may not always be justified. Additionally, the above-described approach of inserting a key into the lock for transport does not provide a solution for those cases where more than one key is to be provided and it is undesirable to place any of the keys inside the article concerned. For example, where the article is the processor box of a PC, it would be highly undesirable to require an end user to have to open up the processor box merely to retrieve a spare key.

It is an object of the present invention to provide a key holder providing a more appropriate solution to some of the situations discussed above.

SUMMARY OF THE INVENTION

According to one aspect of the present invention, there is provided a key holder for holding at least one key, the key holder comprising a shank portion configured to permit it to be inserted into a plurality of different locks of the same type without being usable to operate them, and a key-carrier portion connected to said shank portion at one end thereof and adapted to carry said at least one key fixed in a plane transverse to the direction of extent of the shank portion.

Advantageously, the key holder is of one piece construction and is made of a resiliently deformable plastics material.

In use, the shank portion of the key holder is inserted into the lock and the said at least one key is placed in the key-carrier portion. In this position, the said at least one key does not protude greatly from the lock but will normally lie up against a wall member of an article in which the lock is mounted. The said at least one key is thus readily accessible whilst being in a position in which the article can be safely transported without fear of breaking off the key or key holder, the risk of damage to the key holder also being minimised by making it of a resilient material. Typically, the key-carrier portion is dimensioned to hold two keys.

According to another aspect of the present invention, there is provided a key holder for holding at least one key, the key holder comprising a shank portion insertable into a lock intended to be operated by a said key, and a key-carrier portion connected to said shank portion at one end thereof and adapted to hold said at least one key fixed in a plane transverse to the direction of extent of said shank portion.

According to a further aspect of the present invention, there is provided a key holder for holding at least one key, the key holder comprising a spigot portion engagable in a hole in an article provided with a lock, and a key-carrier portion connected to said spigot portion at one end thereof and adapted to hold said at least one key fast in a plane transverse to the direction of extent of said spigot portion.

According to a still further aspect of the present invention, there is provided, in combination, an article having an externally-operable lock and an external wall member in the region of the lock, at least one key insertable into said lock to operate the latter, and a key holder having a shank portion insertable into the lock and a key-carrier portion connected to one end of the shank portion and adapted to hold said at least one key fixed in a plane which when the shank portion is inserted into said lock, lies substantially parallel to said external wall member.

According to a yet further aspect of the present invention, there is provided a method for associating at least one key with a corresponding lock, the method being for use where there are a plurality of locks of the same type each operable by a different corresponding said at least one key; the method comprising the steps of:

(a) providing a plurality of substantially identical key holders each comprising a shank portion insertable into any one of said locks, and a key-carrier portion connected to said shank portion at one end thereof and adapted to carry any said at least one key; and (b) taking any one of said key holders and both inserting it into a said lock, and engaging the said at least one key corresponding to this lock with said key-carrier portion of the key holder; the inserting and engaging sub-steps of this step (b) being carried out in any desired order.

BRIEF DESCRIPTION OF THE DRAWINGS

Embodiments of the invention will now be described, by way of non-limiting example, with reference to the accompanying diagrammatic drawings, in which.

BEST MODE OF CARRYING OUT THE INVENTION

Figure 1:
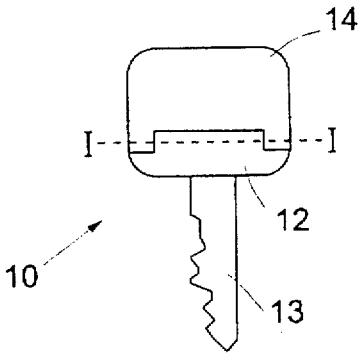
FIG. 1 (PRIOR ART)
FIG. 1 is a front view of a known form of key in which a part of the key head can be folded down to lie in a plane normal to the key shank.

The first form of key holder 20 embodying the invention is illustrated in FIGS. 3 to 7 and comprises a shank portion 21, and a key-carrier portion 22 rigidly connected to one end of the shank portion. The key-carrier portion 22 is made up of a flat support member 23 extending in a plane substantially normal to the direction of extent of the shank portion 21, and a portal member 24 that is upstanding from the front face of the support member 23. The key holder 20 (and, indeed, all the other embodiments of the invention described hereinafter) is advantageously made as a one-piece plastics moulding out of a resiliently-deformable plastics material such as polyethylene or polypropylene.

The portal member 24 is dimensioned to receive a pair of keys 26 and to wedge or resiliently grip them against the support member 23 such that they are retained there in position unless given a good pull/push to extract them. If desired, the portal member can be internally provided with inwardly directed resilient fingers (not shown) to increase the retention force. It will be observed that when held against the support member 23, the keys lie in a plane substantially normal to the direction of extent of the shank portion 21. The portal member 24 can be dimensioned to receive a different number of keys 26 from two, such as one or three.

The keys are intended to operate a lock 27 (shown dotted in FIG. 6) and the shank portion 21 of the key holder 20 is fashioned to be insertable into that lock, preferably with an interference fit so that the key holder cannot easily fall out. Generally, the shank portion is not shaped to operate any one particular lock (though this is possible) but is adapted to be inserted in all locks of a particular series or type (that is, locks of the same size and construction but generally operable by different respective keys). One way of achieving this lock-type wide insertion characteristic is to form the shank portion straight-sided, without lock operating protrusions; thus, where the lock is a cylinder lock, the shank portion preferably does not engage the operating pins of the lock. It may be noted that in contrast to this latter arrangement, the shank portion could instead be configured such that when inserted in any of a series of locks, at least one operating pin of the lock engaged in a recess in the shank portion so as to retain the key holder in position; with such an arrangement, the shank portion need not be an interference fit in the lock in order for the key holder to be retained in place.

The mounting of the lock 27 in a wall 28 of an article, such as a computer processor box, will generally be such that when the key holder 20 has its shank portion inserted into the lock, the support member 23 of the key holder, and thus the keys 26, will lie in a plane parallel to and juxtaposed the wall 28. In this position, the key holder and keys are unlikely to be damaged during transit. The risk of the shank portion snapping off from the key-carrier portion is further reduced where the key holder is made of a resiliently-deformable material since the key-carrier portion can then bend relative to the shank portion (preferably through a substantial angle—for example, 15 degrees or more).

When the article using the lock 27 is manufactured, it is a simple matter to insert the lock keys 26 into a key holder 20 randomly taken from a pile of identical key holders, and then to insert the shank portion 21 of the key holder into the lock 26 thereby associating the lock and keys in a manner secure for transport. Of course, the keys could be inserted into the key holder after insertion of the latter into the lock.

Many variants are possible on the form of key holder shown in FIGS. 3 to 7 and a number of these variants will now be described.

Figure 8:
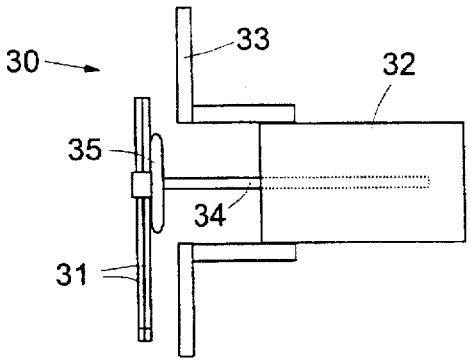
FIG. 8 is a side view of a second form of key holder embodying the invention, the key holder holding two keys and being shown inserted into a lock.

Thus, FIG. 8 is a side view of a second form of key holder 30 embodying the invention. The key holder 30 holds two keys 31 and is inserted in a lock 32 mounted in a recess in a wall 33. The key holder 30 is of the same general construction as the key holder 20 but has an extended shank portion 34 to enable the lock to be reached whilst permitting the keys to lie flat juxtaposed the wall 33. The key holder 30 also has a smaller support member 35 relative to the size of the keys as compared to the support member 23 of the key holder 20.

Figure 9:
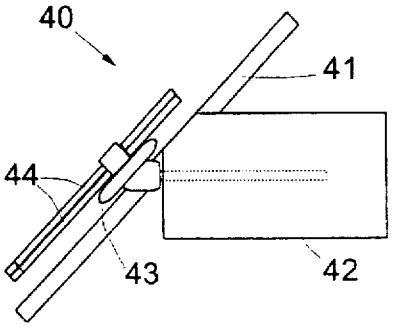
FIG. 9 is a side view of a third form of key holder embodying the invention, the key holder holding two keys and being shown inserted into a lock.

Another possible variant is shown in FIG. 9 which is a side view of a third form of key holder 40 embodying the invention, this form of key holder being adapted for use here the wall 41 mounting the lock 42 is inclined relative to the plane normal to the insertion direction of a key into the lock. In this case, the support member 43 of the key holder 40 must also be similarly inclined if, as desired, the keys 44 are to lie in a plane substantially parallel to the wall 41 when the key holder 40 is inserted in the lock 42.

Figure 2:
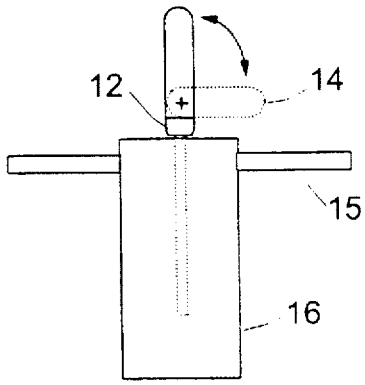
FIG. 2 (PRIOR ART)
FIG. 2 is an side (edge-on) view of the FIG. 1 key showing it inserted into a lock with its key head in a folded down position.
Figure 3:
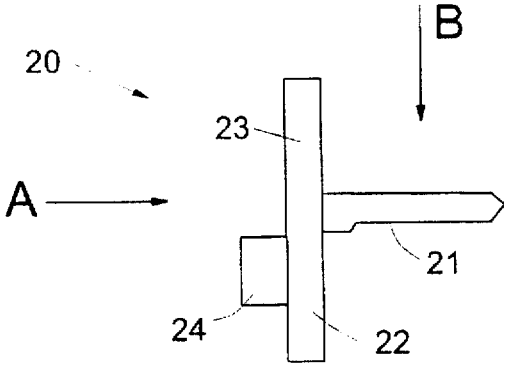
FIG. 3 is a side view of a first form of key holder embodying the invention.
Figure 4:
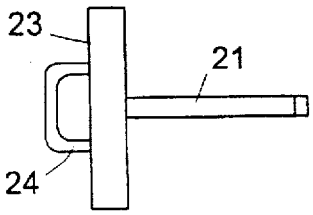
FIG. 4 is a plan view of the FIG. 3 key holder taken in the direction of arrow A of FIG. 3.
Figure 5:
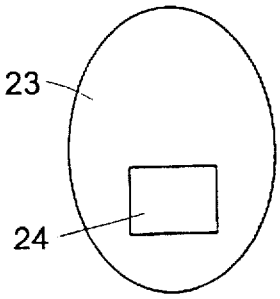
FIG. 5 is a front view of the FIG. 3 key holder taken in the direction of arrow B of FIG. 3.
Figure 6:
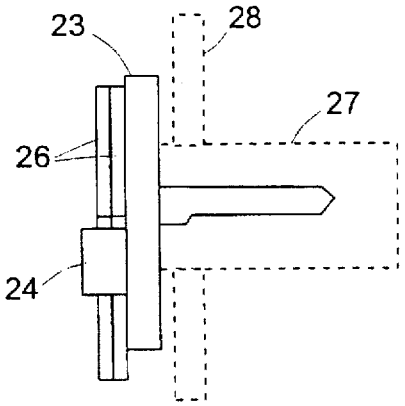
FIG. 6 is a view of the FIG. 3 key holder similar to the view shown in that Figure but showing two keys inserted in the holder.
Figure 7:
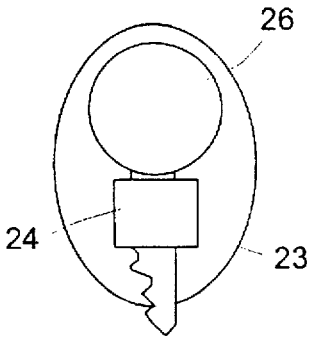
FIG. 7 is a view of the FIG. 3 key holder similar to that of FIG. 5 but showing two keys inserted in the holder.
Figure 10:
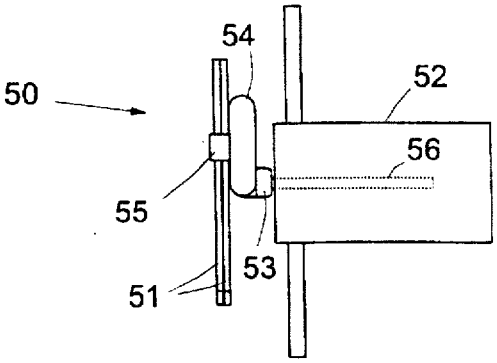
FIG. 10 is a plan view of a fourth form of key holder embodying the invention, the key holder holding two keys and being shown inserted into a lock.

A further possible variant is shown in FIG. 10 which is a plan view of a fourth form of key holder 50 embodying the invention, the key holder 50 again holding two keys 51 and being inserted in a lock 52. This form of key holder 50 incorporates features of the form of key shown in FIGS. 1 and 2 with the key-carrier portion of the key holder comprising a base part 53 on which is pivotally mounted a main part 54 forming the key-carrier support member. The pivotal main part 54 is provided with a portal member 54 having substantially the same form, and with the same function, as the element 24 of the key holder 20 described above. Preferably, the shank portion 56 of the key holder 50 is capable of operating the lock 52 whereby the key holder itself can be used as a key (for such usage, the main part 54 will be pivoted to lie in the same plane as the shank portion 56).

Figure 11:
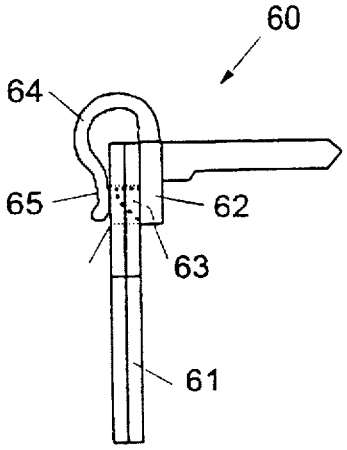
FIG. 11 is a side view of a fifth form of key holder embodying the invention, the key holder holding two keys.
Figure 12:
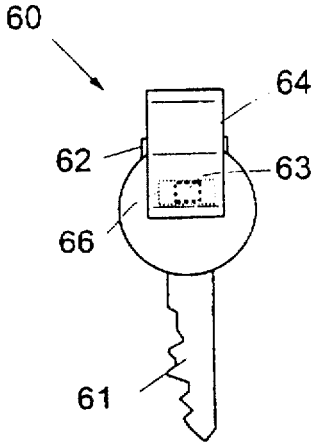
FIG. 12 is a front view of the FIG. 11 key holder.

Yet another variant is shown in FIGS. 11 and 12 which are respectively side and front views of a fifth form of key holder 60 embodying the invention. In this form of key holder, the key-carrier portion rather than comprising a portal member upstanding from a support plate as in the earlier embodiments, is constituted by a support plate 62 provided with a ramp-shaped lug 63 (shown dashed), and a resilient finger 64 having a contact portion 65 that is urged by the resilience of the finger towards the lug 63. The lug 63 is arranged to engage in apertures 66 (shown dashed) formed in two keys 61 when the latter are pushed up into the key holder (as viewed in FIG. 11) to ride up over the lug, pushing the contact portion of the resilient finger away from the lug against the resilient urging of the finger. Once the lug 63 has fully engaged in the apertures 66 in the keys 61, the finger 64 serves to retain then in place against the support plate 62.

Figure 13:
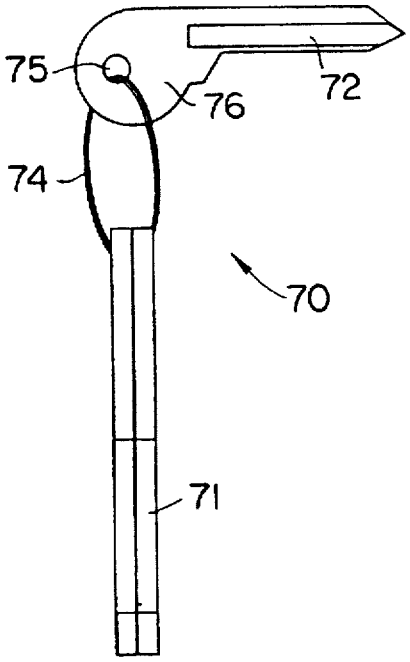
FIG. 13 is a side view of a sixth form of key holder embodying the invention, the key holder holding two keys.
Figure 14:
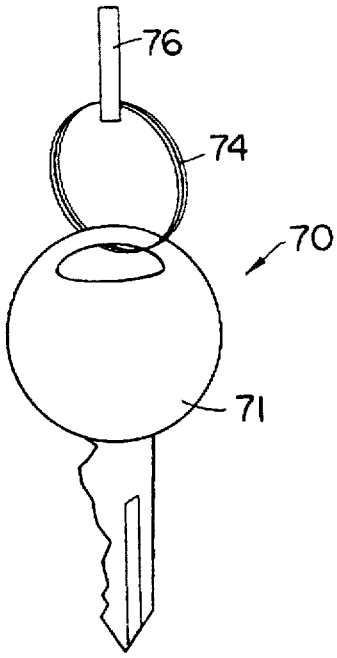
FIG. 14 is a front view of the FIG. 11 key holder.

A somewhat different form of key holder to those described above is shown in FIGS. 13 and 14. In this sixth form 70 of key holder embodying the invention, the keys 71 are not constrained to lie in a plane transverse the direction of extent of a shank portion 72 of the key holder; instead, a key-carrier portion of the key holder is simply constituted by a key ring 74 held captive in an aperture 75 provided in a head-end member 76 integral with one end of the shank portion 72. The key ring 74 which is, for example, of standard split ring form for receiving one or more keys 71, can hang down from the head-end member permitting the keys 71 to assume the most appropriate position. With this arrangement, the keys 71 are less susceptible to damage than the key holder because of their freedom to move. As with the previously described forms of key holder, the key holder is preferably made of a resilient material (such as polyethylene or polypropylene) to minimise the risk of the shank portion being broken off in the lock. Furthermore, it will be appreciated that any of the variants discussed above to the form of the shank portion can also be applied to the shank portion of the key holder 70; in particular, the shank portion will generally be adapted to engage in all the locks of a particular series or type.

Other variations and modifications additional to those discussed above are possible to the described forms of key holder. Thus for example, whilst the key holder is preferably made of a resiliently deformable material, the benefits offered by deformability (protection of the lock and keys from damage) can also largely be achieved by the use of a plastically deformable material for the key holder. Furthermore, the keyholder could be inserted into a hole formed in the article provided with the lock rather than into the lock itself, the hole being suitably dimensioned to grip the shank portion of the key holder. Indeed, where the key holder is always to be inserted into a hole rather than into the lock itself, the shank portion could be replaced by any suitable configured spigot-like member engagable in the hole in a manner to hold the key holder in place (thus, the spigot may include resilient elements snap engaging behind the rear face of an article wall in which the hole is formed.

It will be appreciated that use of the above-described forms of key holder is not restricted to cases where the keys are to be used with a mechanical locking mechanism, but can equally be used where the keys are to be used with other types of lock arrangement, such as magnetic and electrical locks, where there is an insertion aperture for a key.

I claim:

1. In combination, an article provided with a lock, at least one key insertable into said lock to operate said lock and a key holder for holding said at least one key, the key holder comprising a shank portion configured to permit insertion into and engagement with an aperture in said lock, and a key-carrier portion connected to said shank portion at one end thereof, said key-carrier portion adapted to carry said at least one key held fixed in a plane transverse to a direction of extent of said shank portion.

2. A combination according to claim 1, wherein the shank portion is devoid of lock operating protrusions.

3. A combination according to claim 1, wherein said key-carrier portion comprises a support member, and resilient gripping means for holding said at least one key against said support member.

4. A combination according to claim 1, wherein said key-carrier portion comprises a support member, and a portal member upstanding from said support member and into which said at least one key can be inserted to be gripped thereby.

5. A combination according to claim 3, wherein said support member is a plate member that is rigidly coupled to said shank portion and extends substantially perpendicular to the plate member.

6. A combination according to claim 1, wherein the key holder is of a one-piece construction and is made of a resiliently deformable plastics material permitting substantial flexing of the key carrier portion relative to the shank portion.

7. A combination as claimed in claim 1, wherein an aperture is provided in said lock and said shank portion is configured to be inserted into apertures in a plurality of different locks of a same type as said lock without being usable to operate said plurality of different locks.

8. In combination, an article provided with a lock having an aperture, at least one key insertable into said aperture to operate said lock and a key holder for holding said at least one key, the key holder comprising a shank portion configured to permit insertion into, and engagement with, via an interference fit, apertures of a plurality of different locks of a same type as said lock without being usable to operate said plurality of different locks, and a key-carrier portion connected to said shank portion at one end thereof and adapted to carry said at least one key held fixed in a plane transverse to a direction of extent of said shank portion, wherein said key-carrier portion comprises a plate member rigidly coupled to said shank portion and extending substantially perpendicular from said shank portion, and a portal member upstanding from said support member and into which the said at least one key can be inserted and gripped thereby, the key carrier being of a one-piece construction and made of a resiliently deformable plastics material which permits substantial flexing of the key carrier portion relative to the shank portion.

* * * * *